US007172262B2

(12) United States Patent
Sugimura et al.

(10) Patent No.: US 7,172,262 B2
(45) Date of Patent: Feb. 6, 2007

(54) CAPPING UNIT, CAPPING METHOD, AND DROPLET DISPENSE UNIT

(75) Inventors: Shigeo Sugimura, Okaya (JP); Fumio Takagi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 290 days.

(21) Appl. No.: 10/852,210

(22) Filed: May 25, 2004

(65) Prior Publication Data

US 2005/0001873 A1 Jan. 6, 2005

(30) Foreign Application Priority Data

Jun. 13, 2003 (JP) ..... 2003-169813

(51) Int. Cl.
*B41J 2/165* (2006.01)

(52) U.S. Cl. ..... 347/29; 347/30

(58) Field of Classification Search ..... 347/29–33, 347/22, 84–87

See application file for complete search history.

(56) References Cited

U.S. PATENT DOCUMENTS 6,364,449 B1 * 4/2002 Takahashi et al. ..... 347/30
6,827,422 B2 * 12/2004 Horie ..... 347/29

FOREIGN PATENT DOCUMENTS

| | | |
|---|---|---|
| JP | B2-2665469 | 10/1997 |
| JP | A-11-254693 | 9/1999 |
| JP | 2001-186880 | 7/2001 |
| JP | A-2001-301194 | 10/2001 |
| JP | A-2003-127400 | 5/2003 |

* cited by examiner

*Primary Examiner*—Juanita D. Stephens
(74) *Attorney, Agent, or Firm*—Oliff & Berridge, PLC

(57) ABSTRACT

To provide a capping unit, a capping method, and a droplet dispense unit capable of a liquid-filling operation to an inkjet head and recovery operation of the inkjet head in imperfect dispense condition without useless discharge of liquid dispensed by an inkjet system. A capping unit to cover a dispense head with a covering device, the dispense head including cavities to store liquid, nozzles communicating with the cavities, and a dispense device to dispense the liquid stored in the cavities through the nozzles. The covering device is equipped with a first cover including a gas-permeable member having high gas permeability and a second cover including a wetting member to keep the vicinity of the nozzles in a wet condition.

12 Claims, 5 Drawing Sheets

CAPPING UNIT, CAPPING METHOD, AND DROPLET DISPENSE UNIT

BACKGROUND OF THE INVENTION

1. Field of Invention

The present invention relates to a capping unit, a capping method, and a droplet dispense unit.

2. Description of Related Art

In recent years, inkjet units (droplet dispense units) are generally widely used as inkjet printers. The features of the inkjet units include compact and high-density inkjet heads (dispense heads); a very small droplet can be dispensed onto a target position with high accuracy; they are not influenced by the kind and property of a dispensed liquid; they can be applied to any printing media, such as films, cloth, glass substrates, synthetic-resin substrates, and metal substrates in addition to paper; they generate low noise during printing; and cost reduction can be achieved.

The inkjet system has received attention not only to the original printing but also to wide application to, for example, manufacturing DNA chips (also referred to as a DNA microarray). The DNA chips are formed by immobilizing thousands to tens of thousands kinds of DNA fragments in matrix form on a substrate, such as a slide glass, which are used for analyzing the kinds of genes.

SUMMARY OF THE INVENTION

The inkjet units need to fill all the nozzles of the inkjet heads with dispense liquid (ink etc.).

In this filling method, liquid is sucked, with a pump with a suction cap in intimate contact with the nozzle opening face of the inkjet head, and an ink chamber is sucked to be degassed through the nozzle opening face. Thus, the ink chamber is filled with the liquid.

It is, however, difficult to detect that the liquid fills up to the end of the nozzle, so that the liquid is sucked and degassed with the sucking time of the pump longer in some degree. This makes discharging the liquid from the nozzle end difficult.

In the case of manufacturing the DNA chips, not only it is not difficult to fill up to the nozzle end with a very small amount of biopolymer solution but also the very small amount of expensive biopolymer solution is wasted by a filling method similar to that of inkjet units.

With the inkjet units, when imperfect liquid dispensing occurs, it is necessary to carry out a recovery operation, such as flushing for the inkjet heads.

Also in such a case, liquid is sucked from the nozzle opening face with a pump, thus having a problem of discharging the liquid.

The present invention has been made in view of the above problems. Accordingly, the present invention provides a capping unit and method and a droplet dispense unit capable of a liquid filling operation to inkjet heads and a recovery operation of the inkjet heads in an imperfect dispense condition without useless discharge of liquid dispensed by the inkjet system.

A capping unit according to an aspect of the invention covers a dispense head with a cover, the dispense head including cavities to store liquid, nozzles communicating with the cavities, and a dispense device to discharge the liquid stored in the cavities through the nozzles. The cover includes a first cover including a gas-permeable member having high gas permeability; and a second cover including a wetting member to keep the vicinity of the nozzles in a wet condition.

A liquid channel to feed the cavities with the liquid is connected to the dispense head. To the liquid channel, a liquid reservoir, in which the liquid is stored, is connected.

The gas-permeable member denotes a filter etc. which has high gas permeability and which does not allow liquid to pass through at a specified critical pressure or less. The gas-permeable member may be formed of microfibers made of polytetrafluoroethylene etc. and is 1 to 3 μm in mean pore size.

The wetting member denotes a member having a high liquid-absorptive property wetted with liquid. The wetting member is may be made of a porous and elastic material, such as sponge.

According to an aspect of the invention, when liquid is sucked from the nozzle opening face (or the end face of the dispense head) through the gas-permeable member, with the dispense head covered with the first cover, the pressure in the cavities becomes lower than that in the liquid reservoir, so that the liquid in the liquid reservoir flows into the cavities through the liquid channel and fills the entire dispense head. Since the gas-permeable member allows gas to pass through but no liquid to pass through, all the gas in the dispense head is sucked, but the flow of the liquid stops at the end of the nozzles. This allows the gas in the dispense head to be completely sucked and removed and only the liquid to fill up the dispense head. This also reduces or prevents clogging and imperfect dispense due to residual gas in the dispense head.

Furthermore, when the dispense head is covered with the second cover, with the dispense head filled with liquid, the nozzle openings are opposed to the wetting member, so that no liquid evaporates through the nozzles, thereby preventing an increase in viscosity of the liquid which forms a meniscus in the nozzles, clogging and imperfect dispensing due to the increase in viscosity.

In the capping unit according to an aspect of the invention, the first cover includes a first communicating tube communicating with the exterior of the first cover on the opposite side of the gas-permeable member from the dispense head. The second cover includes a second communicating tube communicating with the exterior of the second cover on the opposite side of the wet member from the dispense head.

According to an aspect of the invention, when the interior of the dispense head is sucked with the dispense head covered with the gas-permeable member of the first cover, all the gas in the dispense head is sucked and discharged to the exterior of the capping unit through the first communicating tube. Gas can thus be discharged through the first communicating tube.

When the liquid contained in the wetting member of the second cover exceeds a specified amount, when the second cover is sucked, the liquid in the second cover is discharged to the exterior of the capping unit through the second communicating tube. Liquid can thus be discharged through the second communicating tube.

The capping unit according to an aspect of the invention further includes a section device connected to the first communicating tube and the second communicating tube; and a selection device to select one of the first cover and the second cover to communicate it with the suction device.

The suction device denotes a pump etc. to suck the first cover or the second cover through the first communicating tube or second communicating tube.

The selection device denotes a valve etc. to communicate one of the first cover and the second cover with the suction device.

According to an aspect of the invention, the selection device communicates with one of the first cover and the second cover with the suction device, and the suction device performs a sucking operation, so that the communicated cover can be sucked.

In the capping unit according to an aspect of the invention, the cross-sectional area of the second communicating tube is larger than that of the first communicating tube.

As described above, in the first cover, gas flows in the first communicating tube to be discharged to the exterior of the capping unit by sucking the interior of the dispense head; in the second cover, liquid flows in the second communicating tube to be discharged to the exterior of the capping unit by sucking the liquid that has exceeded a specified amount.

According to an aspect of the invention, even if the viscosity of the liquid in the second communicating tube increases, the clogging in the second communicating tube can be reduced or prevented because the cross-sectional area of the second communicating tube is larger than that of the first communicating tube.

In the capping unit according to an aspect of the invention, the second cover has a projecting section at the part where the second cover comes in contact with the dispense head.

The projecting section denotes a section projecting relative to the flat section around the projecting section. The projecting section may be an elastic member made of rubber, polymeric materials, etc.

According to an aspect of the invention, when the second cover covers the dispense head, part of the dispense head is brought into contact with the projecting section. The contact area of the dispense head with the projecting section is smaller than that of the dispense head with the flat section.

Accordingly, even if the liquid is dried in the contact area, the contact area of the second cover with the dispense head is small owing to the projecting section, so that retention due to drying of the liquid can be reduced or prevented.

A capping method according to an aspect of the invention is a method to cover a dispense head including cavities to store liquid, nozzles communicating with the cavities, and a dispense device to discharge the liquid stored in the cavities through the nozzles. The method includes: a first covering step of covering the dispense head with a first cover including a gas-permeable member having high gas permeability; and covering the dispense head with second cover including a wetting member to store the vicinity of the nozzles in wet condition.

According to an aspect of the invention, when liquid is sucked from the nozzle opening face (or the end face of the dispense head) through the gas-permeable member, with the dispense head covered with the first cover, the pressure in the cavities becomes lower than that in the liquid reservoir, so that the liquid in the liquid reservoir flows into the cavities through the liquid channel and fills the entire dispense head. Since the gas-permeable member allows gas to pass through but no liquid to pass through, all the gas in the dispense head is sucked and the flow of the liquid stops at the end of the nozzles. This allows the gas in the dispense head to be completely sucked and only the liquid to fill up the dispense head. This also reduces or prevents clogging and imperfect dispense due to residual gas in the dispense head.

Furthermore, when the dispense head is covered with the second covering means, with the dispense head filled with liquid, the nozzle opening face is opposed to the wetting member, so that no liquid escapes through the nozzles, thereby reducing the likelihood or preventing an increase in viscosity of the liquid which forms a meniscus in the nozzles and also clogging and imperfect dispense in the nozzles due to the increase in viscosity.

The capping method according to an aspect of the invention further includes a suction step of sucking the dispense head covered with one of the first cover and the second cover.

According to an aspect of the invention, providing the capping method and the suction allows one of the first cover and the second cover to be sucked.

In the capping method according to an aspect of the invention, the cavities of the dispense head are filled with the liquid by the first covering step and the suction step.

According to an aspect of the invention, when the liquid is sucked from the nozzle opening face (or the end face of the dispense head) through the gas-permeable member, with the dispense head covered with the first cover, the pressure in the cavity becomes lower than that in the liquid reservoir, so that the liquid in the reservoir flows into the cavities through the liquid channel and fills the entire dispense head. Since the gas-permeable member allows gas to pass through but no liquid to pass through, all the gas in the dispense head is sucked and the flow of the liquid stops at the end of the nozzles. This allows the gas in the dispense head to be completely sucked and only the liquid to fill up the dispense head.

In the capping method according to an aspect of the invention, the dispense head is kept in wet condition by the second cover, with the dispense head in a dispense stop condition.

The dispense stop condition denotes a state in which the base plate is being carried into the droplet dispense unit, a state in which the substrate is being carried out, and a state in which even if the base plate is placed on the stage of the droplet dispense unit, the droplet dispense operation is waited for.

According to an aspect of the invention, the second covering means covers the dispense head in a droplet-dispense stop condition, so that the nozzle opening face is brought into contact with the wetting member. Liquid is therefore prevented from drying at the nozzle opening face. This reduces or prevents an increase in viscosity of the liquid which forms a meniscus in the nozzle.

In the capping method according to an aspect of the invention, the dispense head is recovered to a preferable dispense condition by continuously performing the first covering step, the suction step, and the second covering step, with the dispense head in an imperfect dispense condition.

The imperfect dispense condition includes conditions in which liquid is not normally dispensed, such as a condition in which no liquid is dispensed from the nozzles even if the dispense device operates, a condition in which an error is produced in the target position owing to deviation even if the liquid is dispensed.

The preferable dispense condition denotes a condition opposite to the imperfect dispense condition, in which liquid is normally dispensed.

According to an aspect of the invention, the interior of the dispense head is sucked through the gas-permeable member and the liquid in the vicinity of meniscus in the nozzles is shifted and agitated in the first covering step and the suction step. The dispense head is kept in wet condition in the second covering step.

The dispense head in the imperfect dispense condition can thus be recovered to the preferable dispense condition.

In the capping method according to an aspect of the invention, the dispense head performs specified times of droplet dispense to the wetting member in the second covering step to recover the dispense head.

The specified times of droplet dispense denotes flushing, what is called, waste dispense and trial dispense.

According to an aspect of the invention, the liquid in the vicinity of the meniscus in the nozzles is shifted and agitated by the specified times of droplet dispense. The dispense head in the imperfect dispense condition can thus be recovered to the preferable dispense condition.

A droplet dispense unit according to an aspect of the invention includes a dispense head including: cavities to store liquid, nozzles communicating with the cavities, and a dispense device to discharge the liquid stored in the cavities through the nozzles; and a liquid reservoir to feed the cavities with the liquid, the droplet dispense unit including the capping unit described above.

According to an aspect of the invention, when the liquid is sucked from the nozzle opening face (or the end face of the dispense head) through the gas-permeable member, with the dispense head covered with the first cover, the pressure in the cavities becomes lower than that in the liquid reservoir, so that the liquid in the liquid reservoir flows into the cavities through the liquid channel and fills the entire dispense head. Since the gas-permeable member allows gas to pass through but no liquid to pass through, all the gas in the dispense head is sucked and the flow of the liquid stops at the end of the nozzles. This allows the gas in the dispense head to be completely sucked and only the liquid to fill up the dispense head. This also reduces or prevents clogging and imperfect dispense due to residual gas in the dispense head.

Furthermore, when the dispense head is covered with the second cover, with the dispense head filled with liquid, the nozzle opening face is brought into contact with the wetting member, so that no liquid escapes through the nozzle, thereby reduce or preventing an increase in viscosity of the liquid which forms a meniscus in the nozzles and also clogging and imperfect dispense in the nozzles due to the increase in viscosity.

DETAILED DESCRIPTION OF EXEMPLARY EMBODIMENTS

Figure 1:
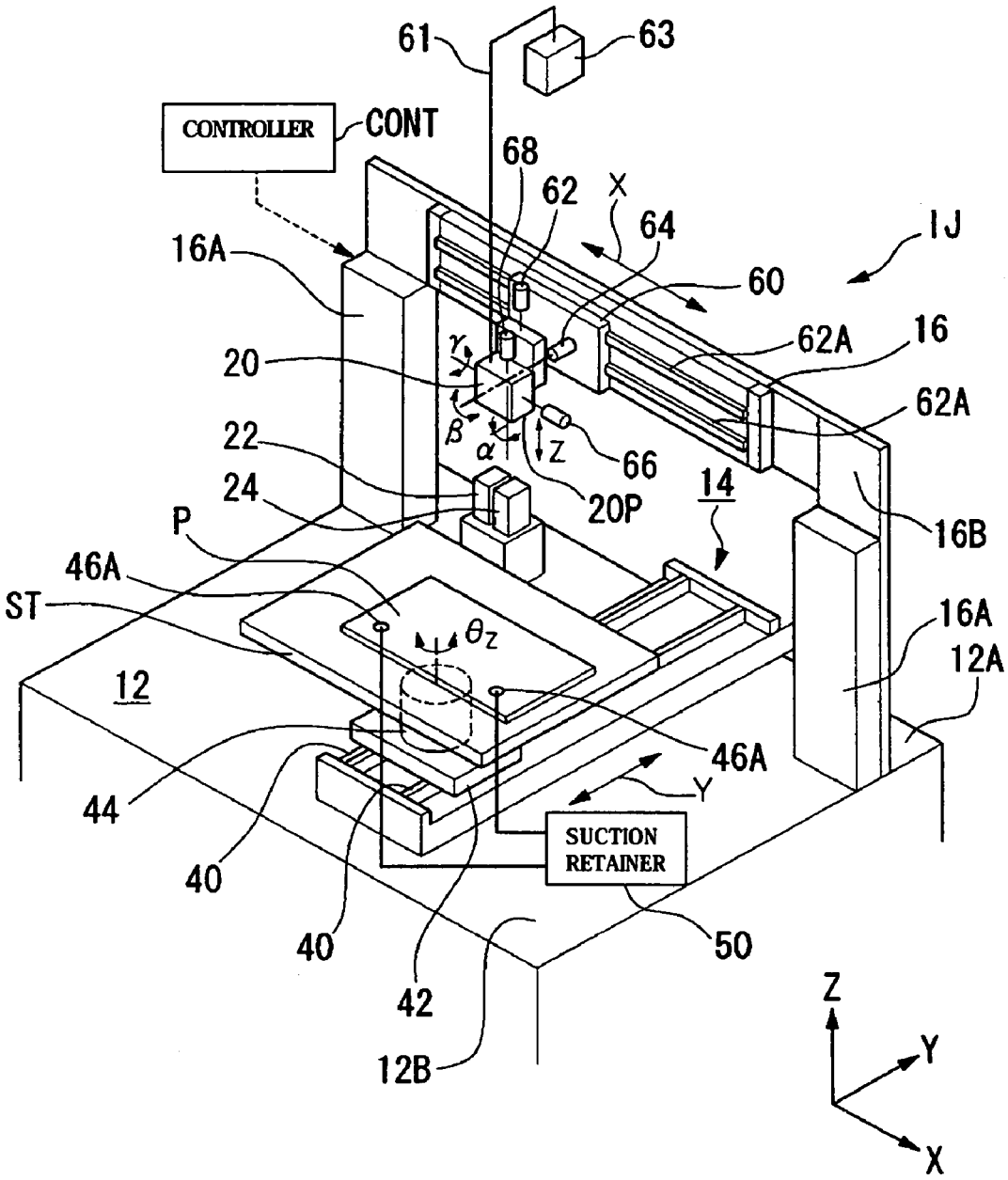
FIG. 1 is a schematic of a droplet dispense unit according to an exemplary embodiment of the present invention.

A capping unit, a capping method, and a droplet dispense unit according to an aspect of the present invention will be described with reference to the drawings. FIG. 1 is a schematic of a droplet dispense unit according to an exemplary embodiment of the present invention.

Droplet Dispense Unit

Referring to FIG. 1, a droplet dispense unit IJ includes a base 12, a stage ST to support a base plate P on the base 12, a first shifter 14 interposed between the base 12 and the stage ST to movably support the stage ST, a dispense head 20 capable of discharging a specified liquid material to the base plate P supported by the stage ST, a second shifter 16 movably supporting the dispense head 20, a tank (liquid reservoir) 63 in which the liquid dispensed from the dispense head 20 is stored, a liquid channel 61 to feed the dispense head 20 with the liquid, a controller CONT to control the liquid dispense operation of the dispense head 20, a capping unit 22 disposed on the base 12, and a cleaning unit 24. The operation of the droplet dispense unit IJ including the first shifter 14 and the second shifter 16 is controlled by the controller CONT.

The first shifter 14 is disposed on the base 12 and positioned along the Y-axis. The second shifter 16 is erected from the base 12 with supports 16A and 16A, on the rear 12A of the base 12. The X-axis of the second shifter 16 is perpendicular to the Y-axis of the first shifter 14. The Y-axis is directed along the direction of the front 12B and the rear 12A of the base 12. The X-axis is along the lateral direction of the base 12, which are horizontal. The Z-axis is perpendicular to the X-axis and the Y-axis.

The first shifter 14 is constructed of, for example, a linear motor, which includes guide rails 40 and 40 and a slider 42 which moves along the guide rails 40. The slider 42 of the linear-motor first shifter 14 can be moved along the guide rails 40 in the Y-axis direction, thereby being positioned.

The slider 42 includes a motor 44 for Z-axis (θZ) rotation. The motor 44 is, for example, a direct drive motor, whose rotor is fixed to the stage ST. Accordingly, when the motor 44 is energized, the rotor and the stage ST rotate along the θZ-direction, thereby indexing the stage ST. Specifically, the first shifter 14 can move the stage ST in the Y-axis direction and in the θZ-direction.

The stage ST retains the base plate P in a specified position. The stage ST includes a suction retainer 50 and adsorbs to retain the base plate P onto the stage ST through the holes 46A of the stage ST by the operation of the suction retainer 50.

The second shifter 16 is constructed of a linear motor, which includes columns 16B fixed to the supports 16A and 16A, a guide rail 62A supported by the columns 16B, and a slider 60 movably supported along the guide rail 62A in the X-axis direction. The slider 60 is moved in the X-axis direction along the guide rail 62A, thereby being positioned. The dispense head 20 is mounted to the slider 60.

The dispense head 20 includes motors 62, 64, 66, and 68 serving as oscillation positioning units. When the motor 62 is driven, the dispense head 20 is moved vertically along the Z-axis, thereby being positioned. The Z-axis is orthogonal to the X- and Y-axes (in the vertical direction). When the motor 64 is driven, the dispense head 20 fluctuates in the β-direction around the Y-axis, thereby being positioned. When the motor 66 is driven, the dispense head 20 fluctuates in the γ-direction around the X-axis, thereby being positioned. When the motor 68 is driven, the dispense head 20 fluctuates in the α-direction around the X-axis, thereby being positioned.

Briefly, the second shifter 16 supports the dispense head 20 such that it can move along the X-axis and the Z-axis and also it can move in the θX-direction (along the X-axis), in the θY-direction (along the Y-axis), and in the θZ-direction (along the Z-axis).

The dispense head 20 of FIG. 1 can be positioned by moving linearly in the Z-axis direction with the slider 60 and also positioned by oscillating along α, β, and λ. The position or attitude of the liquid dispense face (nozzle opening face) 20P of the dispense head 20 can be controlled accurately with respect to the base plate P of the stage ST. The liquid dispense face 20P of the dispense head 20 has multiple nozzles to discharge liquid.

Figure 2:
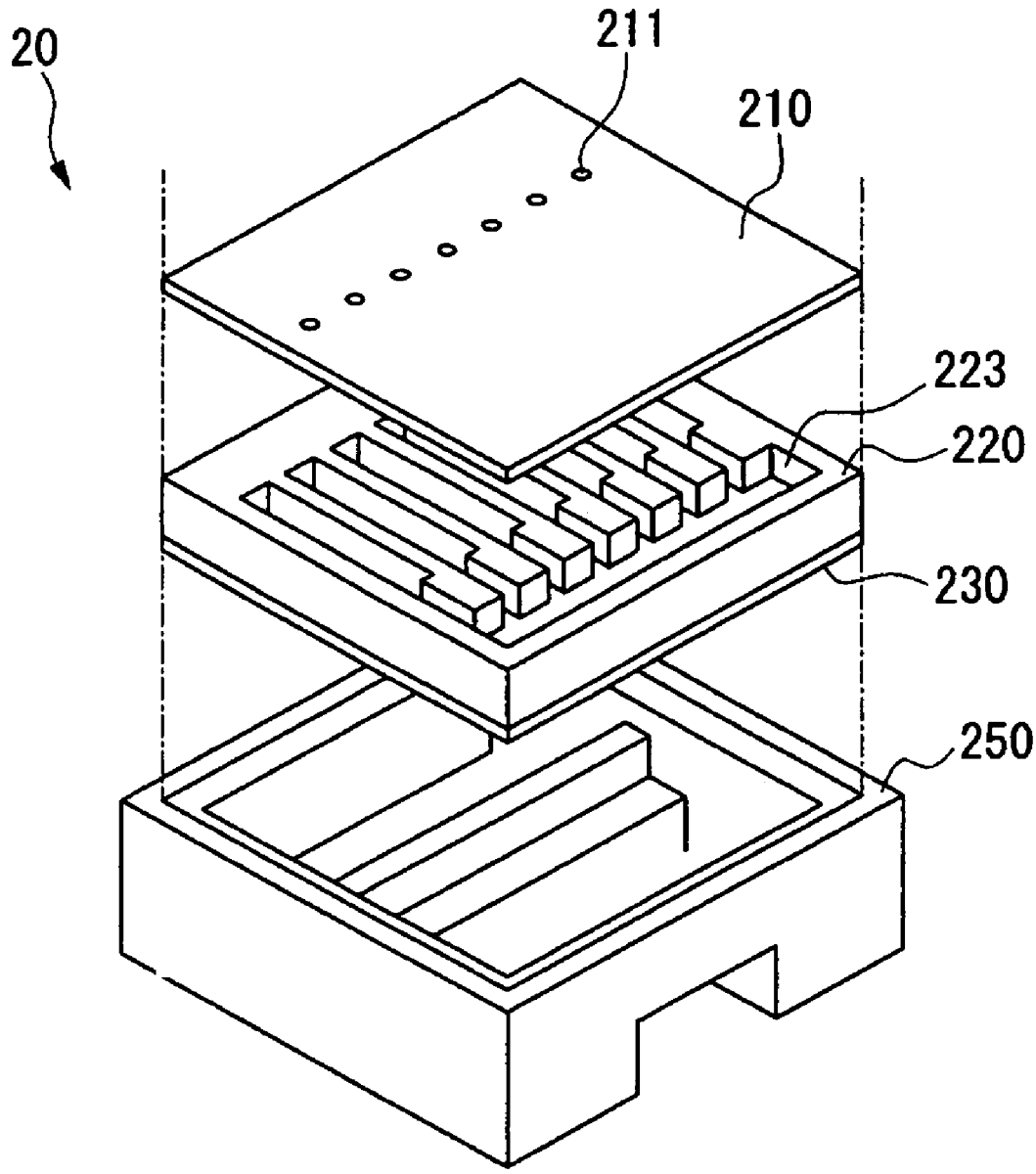
FIG. 2 is a schematic of a dispense head.

FIG. 2 is a schematic of the dispense head 20.

Figure 3:
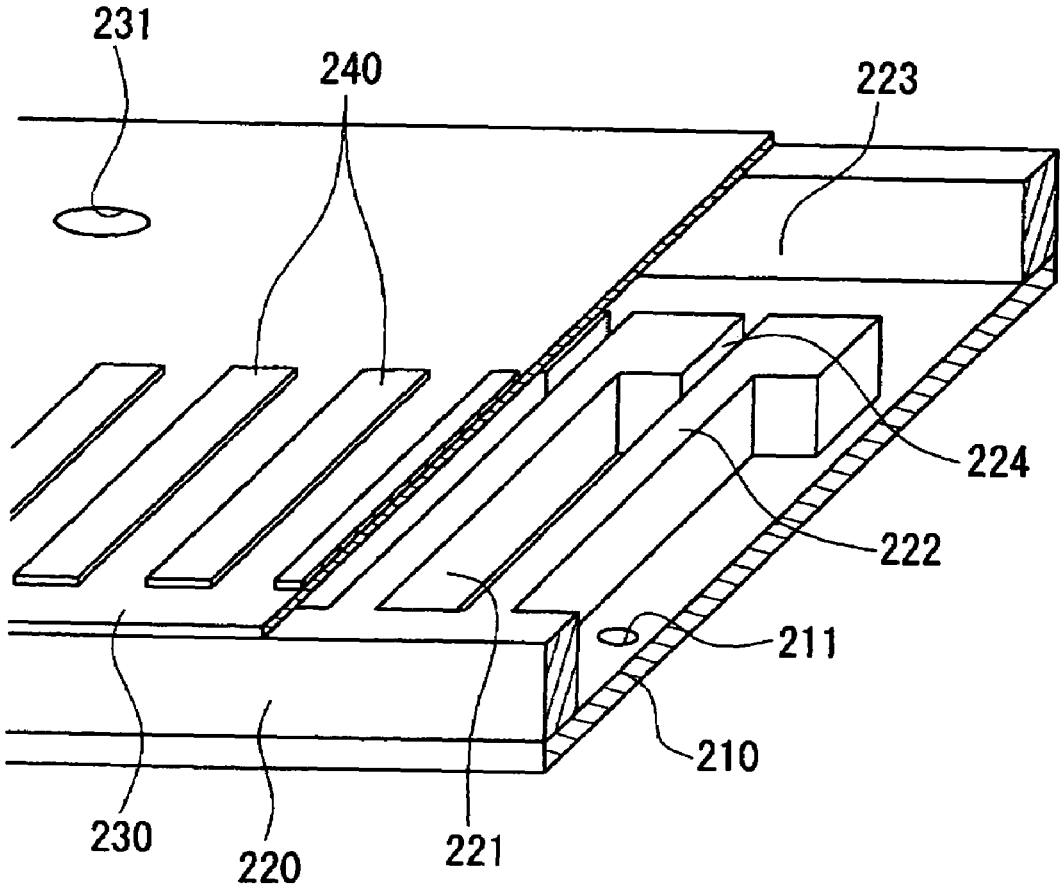
FIG. 3 is a schematic of the principal part of the dispense head.

As shown in FIG. 2, the dispense head 20 is constructed such that a nozzle plate 210 having nozzles 211 and a pressure-chamber base plate 220 having an oscillating plate 230 are fitted in a casing 250. As shown in the schematic of FIG. 3, the principal structure of the dispense head 20 has a structure in which the pressure-chamber base plate 220 is sandwiched between the nozzle plate 210 and the oscillating plate 230. The nozzle plate 210 has the nozzles 211 in the positions that correspond to cavities 221 when bonded to the pressure-chamber base plate 220. The pressure-chamber base plate 220 has the cavities 220 formed by etching a silicone monocrystal substrate etc., each serving as a pressure chamber. The cavities 221 are divided by sidewalls (partitions) 222. The cavities 221 communicate with a reservoir 223 serving as a common flow channel through supply ports 224. The oscillating plate 230 is made of, for example, a thermal oxidization film. The oscillating plate 230 has a liquid tank opening 231, into which arbitrary liquid can be supplied from the tank 63 of FIG. 1 through the liquid channel 61. The oscillating plate 230 has piezoelectric elements (dispense device) 240 in the positions corresponding to the cavities 221 thereon.

Each piezoelectric element 240 has a structure in which a piezoelectric ceramic crystal, such as a piezoelectric element, is sandwiched between an upper electrode and a lower electrode (not shown). The piezoelectric element 240 can be varied in volume according to a dispense signal sent from the controller CONT.

To dispense liquid from the dispense head 20, the controller CONT first sends a dispense signal to discharge liquid to the dispense head 20. The liquid flows into the cavities 221 of the dispense head 20. The piezoelectric elements 240 of the dispense head 20, which have received the dispense signal, change in volume by the voltage applied between the upper electrode and the lower electrode. The volume change deforms the oscillating plate 230 to change the volume of the cavities 221. As a result, liquid droplets are dispensed from the nozzles 211 of the cavities 221. To the cavities 221 from which the liquid has been dispensed, liquid is newly supplied by an amount corresponding to the dispense.

The foregoing dispense head has a structure in which the piezoelectric element is changed in volume to thereby dispense liquid. However, it may have a head structure in which liquid is heated by a heating element to dispense droplets by its expansion. It may also be a dispense head in which the oscillating plate is deformed by static electricity to change the volume, thereby dispensing droplets.

The second shifter 16 can selectively position the dispense head 20 above the cleaning unit 24 or the capping unit 22 by moving it in the X-axis direction. Specifically, even during manufacturing a device, for example, the dispense head 20 can be cleaned by moving the dispense head 20 to a position above the cleaning unit 24. When the dispense head 20 is shifted to a position above the capping unit 22, the liquid dispense face 20P of the dispense head 20 can be subjected to capping, the liquid can be charged into the cavities 221, or imperfect dispense can be recovered. Specifically, the cleaning unit 24 and the capping unit 22 are disposed on the rear 12A side on the base 12, directly under the moving pass of the dispense head 20, and separately from the stage ST. Since the carrying-in and -out operations of the base plate P to the stage ST are carried out at the front 12B of the base 12, the operations are not hindered by the cleaning unit 24 or the capping unit 22.

The liquid to be dispensed from the dispense head 20 includes inks containing coloring materials, dispersions containing metallic fine particles etc., solutions containing organic EL substances including hole injection materials, such as PEDOT:PSS, and luminescent materials, high-viscosity functional liquids, such as liquid crystal materials, functional liquids containing microlens materials, and liquids containing various materials. The exemplary embodiment uses biopolymer solutions containing proteins, nuclide acids, etc.

The base plate P may be made of glass etc.

Forming the biopolymer solution on the base plate P allows a microarray, such as DNA chips, to be formed.

The cleaning unit 24 can clean the nozzles of the dispense head 20 regularly or any time during the process of manufacturing the device or during standby.

The capping unit 22 is used to perform capping on the liquid dispense face 20P of the dispense head 20 during standby mode when no device is manufactured, so as to prevent the liquid dispense face 20P from drying, to fill up the cavities 221 with liquid, or to recover the dispense head 20 with imperfect dispense.

Capping Unit

Figure 4A:
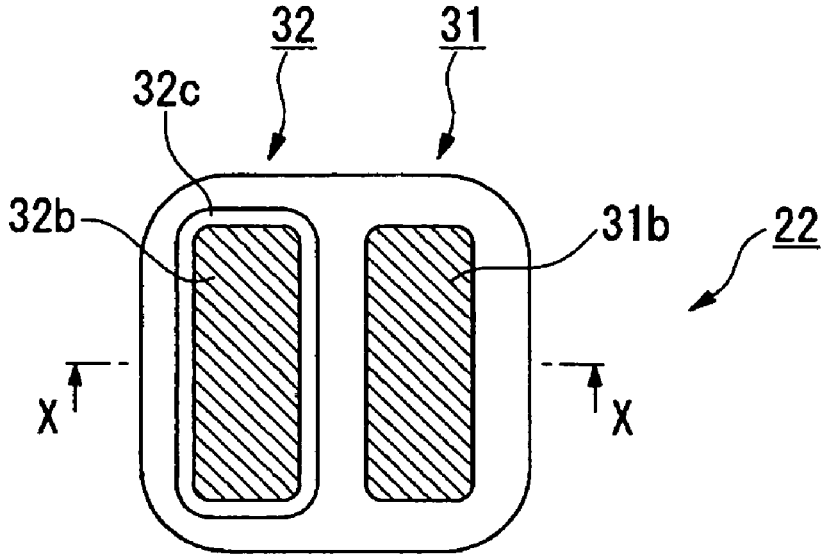
FIGS. 4A and 4B include schematics of the structure of a capping unit.
Figure 4B:
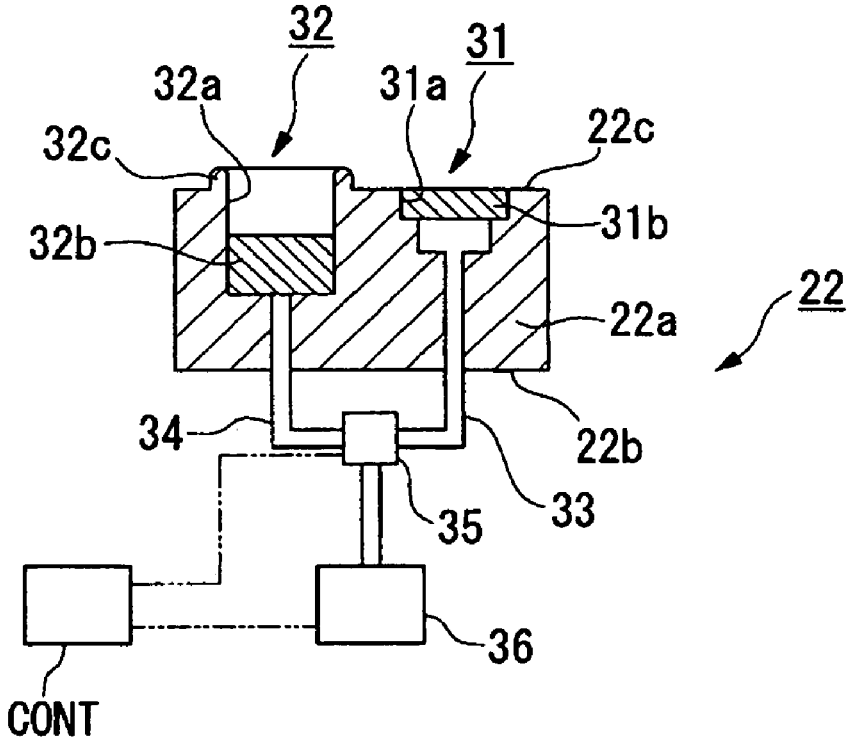

FIG. 4 shows the structure of the capping unit 22, wherein FIG. 4(A) is a plan view seen from the dispense head; and FIG. 4(B) is a sectional view taken along plane X—X of FIG. 4(A).

As shown in FIGS. 4(A) and (B), the capping unit 22 includes a body 22*a*, a first capping section (first cover) 31, a first communicating tube 33, a second capping section (second cover) 32, a second communicating tube 34, a selector valve (selection device) 35, and a pump (suction device) 36.

The first capping section 31 includes a gas-permeable filter (gas-permeable member) 31*b* fitted in a recess 31*a* of the body 22*a* and the first communicating tube 33 passing through the lower surface 22*b* of the body 22*a*. The gas-permeable filter 31*b* means a filter having high gas permeability and not allowing liquid to pass through at a specified critical pressure or less. The gas-permeable filter may be 1 to 3 μm in mean pore size and formed of microfibers made of, for example, polytetrafluoroethylene etc.

The second capping section 32 includes a wetting member 32*b* fitted in a recess 32*a* of the body 22*a*, the second communicating tube 34 passing through the lower surface 22*b*, and a projecting section 32*c* projecting from the upper surface of the body 22*c*. The wetting member 32*b* has a high liquid-absorptive property to keep wetness when liquid is absorbed and is made of sponge etc.

The selector valve 35 is connected to the first communicating tube 33, the second communicating tube 34, and the pump 36, which selectively communicates one of the first communicating tube 33 and the second communicating tube 34 with the pump 36.

The pump 36 sucks to decompress the first capping section 31 or the second capping section 32 through the first communicating tube 33 or the second communicating tube 34, respectively, which is brought into communication by the selector valve 35.

The selector valve 35 and the pump 36 are electrically connected to the controller CONT, thus being controlled.

The cross-section area of the second communicating tube 34 is set larger than that of the first communicating tube 33.

Droplet Dispense Method and Capping Method

A method for forming a microarray on the base plate P using the droplet dispense unit IJ of FIG. 1 will be now be described and also a capping method using the capping unit 22 will be described with reference to FIG. 5.

Figure 5A:
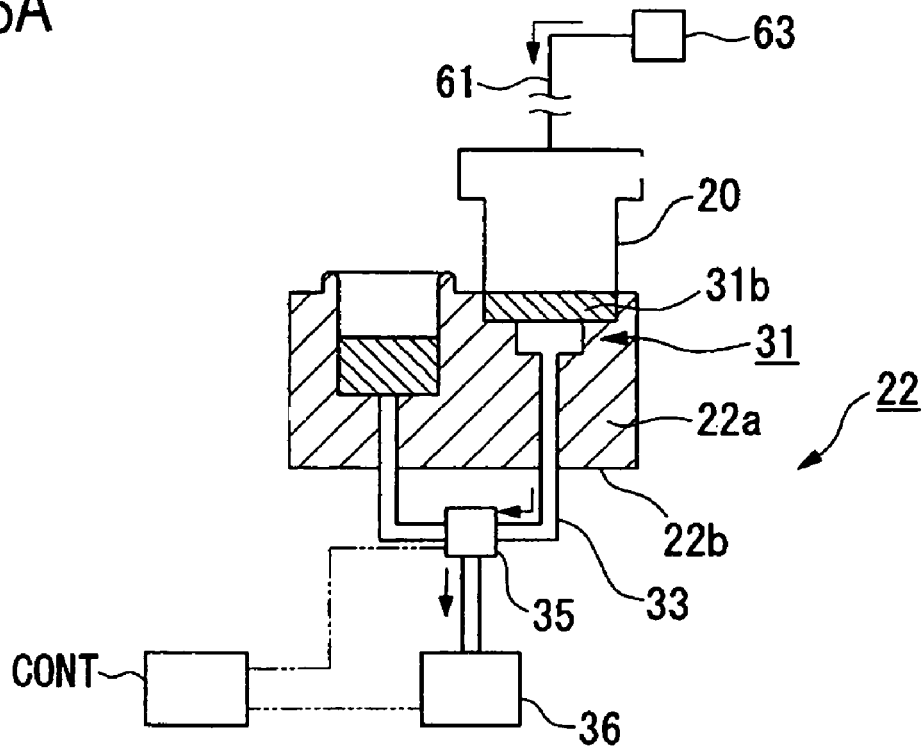
FIGS. 5A and 5B are schematics of an essential part for explaining the operation of the capping unit.
Figure 5B:
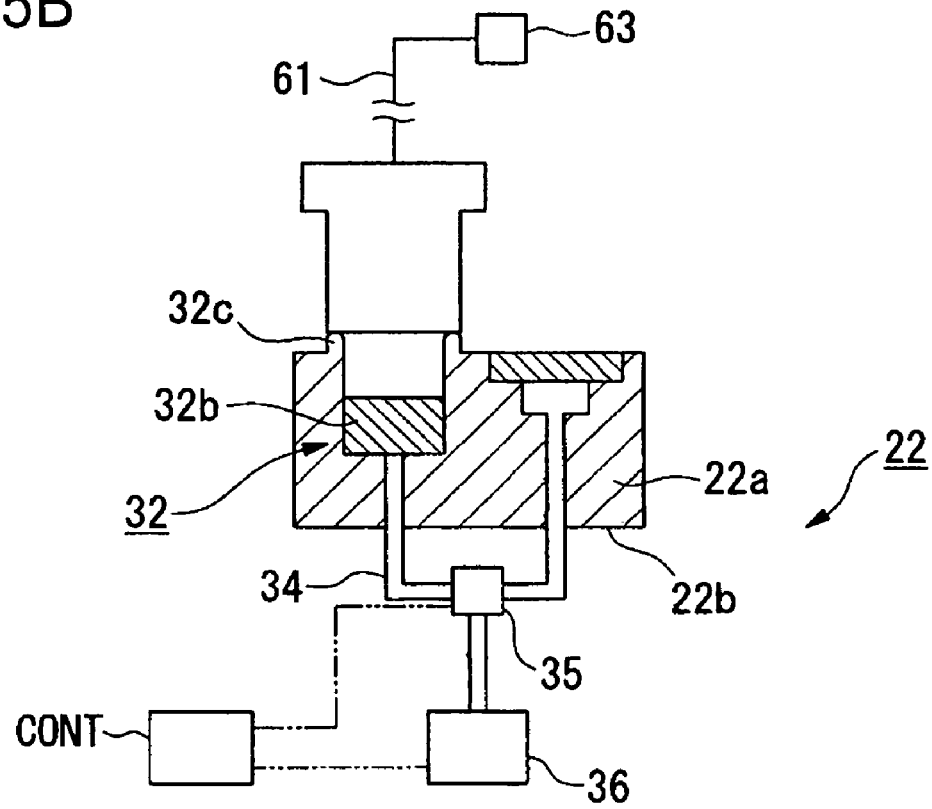

FIG. 5(A) is a sectional view of the capping unit 22 for explaining a capping method with the first capping section 31; and FIG. 5(B) is sectional view of the capping unit 22 for explaining a capping method with the second capping section 32.

A carrying unit (not shown) first carries the base plate P from the front 12B of the stage ST to the stage ST. The stage ST sucks to retain the base plate P, thereby positioning it. The motor 44 is driven to set the end face of the base plate P in parallel to the Y-axis.

While the base plate P is carried to the stage ST, the controller CONT controls the second shifter 16 to shift the dispense head 20 in the X-axis direction to position it above the capping unit 22. The controller CONT further shifts the dispense head 20 in the Z-axis direction to bring it into contact with the capping unit 22. Specifically, as shown in FIG. 5(A) it brings the liquid dispense face 20P of the dispense head 20 into contact with the gas-permeable filter 31*b* of the first capping section 31.

The controller CONT operates the selector valve 35 of the capping unit 22, with the liquid dispense face 20P in contact with the gas-permeable filter 31*b*, to thereby bring the first communicating tube 33 into communication with the pump 36 and to bring the second communicating tube 34 out of communication with the pump 36. The controller CONT then operates the pump 36 to thereby decompress the interior of the cavities 221 of the dispense head 20 through the first communicating tube 33. Accordingly, the liquid flows in the liquid channel 61 from the tank 63 toward the dispense head 20 to reach the interior of the cavities 221 of the dispense head 20. Since the gas-permeable filter 31*b* has the property of high gas permeability and not allowing liquid to pass through at a critical pressure or less, as described above, the liquid in the cavities 221 does not permeate through the first capping section 31 through the gas-permeable filter 31*b*, while the gas in the dispense head 20 is sucked through the gas-permeable filter 31*b*. Therefore, gas does not remain in the cavities 221 of the dispense head 20 but only liquid is charged.

After completion of charging the liquid, the controller CONT dispenses the liquid from specified nozzles of the dispense head 20 onto the base plate P with a specified width while moving (scanning) the dispense head 20 relative to the base plate P in the X-axis direction, thereby forming a microarray. In this exemplary embodiment, the dispense head 20 performs dispense operation while moving in the +X-axis direction with respect to the base plate P.

Upon completion of the first relative displacement (scanning) of the dispense head 20 and the base plate P, the stage ST which supports the base plate P moves a specified distance by step in the Y-axis direction with respect to the dispense head 20. The controller CONT performs dispense operation while performing the second relative displacement (scanning) of the dispense head 20, for example, in the −X-axis direction with respect to the base plate P. By repetition of this operation two times, the dispense head 20 dispenses the liquid under the control of the controller CONT to form a microarray onto the base plate P.

After the microarray has thus been formed on the base plate P, the sucking retention by the stage ST is released, so the carrying unit carries the base plate P from the stage ST.

While the base plate P is carried from the stage ST, the controller CONT controls the second shifter 16 to shift the dispense head 20 in the X-axis direction, thereby positioning it above the capping unit 22. The controller CONT further shifts the dispense head 20 in the Z-axis direction to bring it into contact with the capping unit 22. Specifically, as shown in FIG. 5(B), the controller CONT opposes the liquid dispense face 20P of the dispense head 20 to the wetting member 32*b* of the second capping section 32, thereby bringing it into engagement with the projecting section 32*c*.

By disposing the dispense head 20 in the second capping section 32, the dispense head 20 is kept with the liquid dispense face 20P in wet condition. Accordingly, the liquid dispense face 20P is prevented from drying.

The dispense head 20 is kept this way not only while the base plate P is carried in and out from the droplet dispense unit IJ but also while droplet dispense operation is not carried out.

As described above, since the droplet dispense unit IJ is equipped with the gas-permeable filter 31*b*, the gas in the dispense head 20 can be completely removed by suction and only liquid can be charged in the dispense head 20. Also, clogging and imperfect dispense due to residual gas in the dispense head 20 can be reduced or prevented.

Since the wetting member 32*b* is provided, an increase in viscosity of the liquid which forms a meniscus in the nozzles 211 can be reduced or prevented. Also, clogging and imperfect dispense in the nozzles 211 due to the increase in viscosity can be reduced or prevented.

Since the first communicating tube 33 and the pump 36 are provided, when the interior of the dispense head 20 is sucked with the gas-permeable filter 31*b* covering the dispense head 20, the gas in the dispense head 20 can be discharged through the first communicating tube 33.

Since the selector valve 35 is provided, any one of the first capping section 31 and the second capping section 32 can be selectively sucked.

When the dispense head 20 is disposed to the second capping section 32, the dispense head 20 is in contact with the projecting section 32*c*, allowing the contact area to be minimized to reduce or prevent retention due to the drying of liquid.

A case in which imperfect dispense of liquid occurred in the droplet dispense unit IJ will now be described.

When the occurrence of imperfect liquid dispense is recognized, the controller CONT controls the second shifter 16 to shift the dispense head 20 in the X-axis direction, thereby positioning it to a position above the capping unit 22. The controller CONT further shifts the dispense head 20 in the Z-axis direction to bring it into contact with the capping unit 22. Specifically, as shown in FIG. 5(A), the controller CONT brings the liquid dispense face 20P of the dispense head 20 into contact with the gas-permeable filter 31*b* of the first capping section 31.

The controller CONT operates the selector valve 35 of the capping unit 22, with the liquid dispense face 20P in contact with the gas-permeable filter 31*b*, to bring the first communicating tube 33 into communication with the pump 36 and to bring the second communicating tube 34 out of communication with the pump 36. The controller CONT then operates the pump 36 to decompress the interior of the cavities 221 of the dispense head 20 through the first communicating tube 33, thereby sucking the interior of the dispense head 20 through the gas-permeable filter 31*b*. Accordingly, the liquid in the vicinity of the meniscus in the nozzles 211 is moved and agitated. In this way, bubbles that entered the dispense head 20, which may cause imperfect dispense, can be removed and also a solid from the liquid whose viscosity has increased by drying can be removed.

The controller CONT then controls the second shifter 16 to shift the dispense head 20 in the X-axis direction, thereby positioning it above the capping unit 22. As shown in FIG. 5(*b*), the controller CONT further shifts the dispense head 20 in the Z-axis direction to oppose the liquid dispense face 20P of the dispense head 20 to the wetting member 32*b* of the second capping section 32 into engagement with the projecting section 32*c*.

The controller CONT then operates the piezoelectric element 240 of the dispense head 20 in the second capping section 32, thereby discharging the liquid to the wetting member 32*b*. Accordingly, bubbles in the vicinity of the meniscus in the nozzles 211 can be removed and also a solid from the liquid, whose viscosity has increased by drying, can be removed completely. The dispense head 20 is thus recovered to a preferable dispense condition.

The foregoing recovery operation of the dispense head 20 is not necessarily performed by both of the first capping section 31 and the second capping section 32 but may be performed by any one of them.

When the liquid in the second capping section 32 exceeds a specified amount, the liquid may be removed. In this case, the controller CONT operates the selector valve 35 to bring the first communicating tube 33 out of communication with the pump 36 and the second communicating tube 34 into communication with the pump 36 and operates the pump 36, thereby discharging the liquid in the second capping section 32 through the second communicating tube 34. Since the cross-sectional area of the second communicating tube 34 is set larger than that of the first communicating tube 33, no clogging occurs even if the viscosity of the liquid increases in the second communicating tube 34.

As described above, when imperfect dispense of the dispense head 20 occurs in the droplet dispense unit IJ, the dispense head 20 can be recovered to a preferable dispense condition by the capping by the first capping section 31 and the second capping section 32 and the suction by the pump 36.

Also, specified times of waste dispense to the wetting member 32*b* allows the dispense head 20 to be recovered to a preferable dispense condition.

Since the cross-sectional area of the second communicating tube 34 is set larger than that of the first communicating tube 33, clogging of the liquid in the second communicating tube 34 can be reduced or prevented when the liquid in the second capping section 32 is sucked through the second communicating tube 34.

What is claimed is:

1. A capping unit to cover a dispense head, the dispense head including cavities to store liquid, nozzles communicating with the cavities, and a dispense device to dispense the liquid stored in the cavities through the nozzles, the capping unit comprising:

a cover that includes:

a first cover including a gas-permeable member having high gas permeability and which does not allow liquid to pass through at a specified critical pressure or less; and a second cover including a wetting member to keep the vicinity of the nozzles in a wet condition.

2. The capping unit according to claim 1, the first cover including a first communicating tube communicating with the exterior of the first cover on the opposite side of the gas-permeable member from the dispense head; and the second cover including a second communicating tube communicating with the exterior of the second cover on the opposite side of the wet member from the dispense head.

3. The capping unit according to claim 2, the cross-sectional area of the second communicating tube being larger than that of the first communicating tube.

4. The capping unit according to claim 1, further comprising:

a suction device connected to the first communicating tube and the second communicating tube; and a selection device to select one of the first cover and the second cover to communicate it with the suction device.

5. The capping unit according to claim 1, the second cover has a projecting section at a part where the second cover comes in contact with the dispense head.

6. A droplet dispense unit, comprising:

a dispense head including cavities to store liquid;

nozzles communicating with the cavities;

a dispense device to dispense a liquid stored in the cavities through the nozzles;

a liquid reservoir to feed the cavities with the liquid; and the capping unit according to claim 1.

7. A capping method to cover a dispense head including cavities to store liquid, nozzles communicating with the cavities, and a dispense device to dispense the liquid stored in the cavities through the nozzles, the capping method comprising:

covering the dispense head with a first cover including a gas-permeable member having high gas permeability and which does not allow liquid to pass through at a specified critical pressure or less; and covering the dispense head with a second cover including a wetting member to store the vicinity of the nozzles in wet condition.

8. The capping method according to claim 7, further comprising:

sucking the dispense head covered with one of the first cover and the second cover.

9. The capping method according to claim 7, the cavities of the dispense head being filled with the liquid by sucking the dispense had covered with the first cover.

10. The capping method according to claim 7, the dispense head being kept in a wet condition by the second covering step, with the dispense head in a dispense stop condition.

11. The capping method according to claim 7, the dispense head being recovered to a preferable dispense condition by continuously performing covering the dispense head with a first cover including a gas-permeable member having high gas permeability; sucking the dispense head covered with one of the first cover and the second cover, and covering the dispense head with a second cover including a wetting member to store the vicinity of the nozzles in wet condition with the dispense head in an imperfect dispense condition.

12. The capping method according to claim 7, the dispense head performing specified times of droplet dispense to the wetting member in covering the dispense head with a second cover including a wetting member to store the vicinity of the nozzles in wet condition to recover the dispense head.

* * * * *